US006220342B1

(12) United States Patent
Nishishita et al.

(10) Patent No.: US 6,220,342 B1
(45) Date of Patent: Apr. 24, 2001

(54) LAMINATED HEAT EXCHANGER

(75) Inventors: Kunihiko Nishishita; Seiji Inoue; Kiyoshi Tanda; Hitoshi Sakata, all of Konan-machi (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/107,466

(22) Filed: Jun. 30, 1998

Related U.S. Application Data

(62) Division of application No. 08/890,755, filed on Jul. 11, 1997, which is a division of application No. 08/600,276, filed on Feb. 12, 1996.

(30) Foreign Application Priority Data

Feb. 16, 1995 (JP) ..... 7-51722
Sep. 11, 1995 (JP) ..... 7-258165

(51) Int. Cl.[7] ..... F28D 1/02

(52) U.S. Cl. ..... 165/153; 165/174; 165/173; 62/515

(58) Field of Search ..... 165/174, 166, 165/167, 153, 176; 62/515

(56) References Cited

U.S. PATENT DOCUMENTS

| | | | | |
|---|---|---|---|---|
| 4,274,482 | | 6/1981 | Sonoda . | |
| 4,821,531 | | 4/1989 | Yamauchi et al. . | |
| 5,042,577 | | 8/1991 | Suzumura . | |
| 5,186,249 | | 2/1993 | Bhatti et al. . | |
| 5,203,407 | * | 4/1993 | Nagasaka | 165/174 |
| 5,355,947 | * | 10/1994 | Rasso, Jr. et al. | 165/176 |
| 5,390,507 | | 2/1995 | Shimoya et al. . | |
| 5,413,169 | | 5/1995 | Frazier et al. . | |
| 5,671,808 | * | 9/1997 | Kleyn | 165/174 X |
| 5,727,626 | * | 3/1998 | Kato | 165/153 X |

FOREIGN PATENT DOCUMENTS

| | | | | |
|---|---|---|---|---|
| 0 625 686 | | 11/1994 | (EP) . | |
| 0 678 721 | | 10/1995 | (EP) . | |
| 0859510 | | 1/1946 | (FR) . | |
| 2056648 | * | 3/1981 | (GB) | 165/167 |
| 1063788 | | 3/1989 | (JP) . | |
| 0068500 | | 3/1990 | (JP) . | |
| 0140795 | | 6/1991 | (JP) . | |
| 403247993 | * | 11/1991 | (JP) | 165/174 |
| 403247992 | * | 12/1991 | (JP) | 165/174 |
| 4184097 | | 7/1992 | (JP) . | |
| 404324078 | * | 11/1992 | (JP) | 62/515 |

* cited by examiner

*Primary Examiner*—Christopher Atkinson
(74) *Attorney, Agent, or Firm*—Wenderoth, Lind & Ponack, L.L.P.

(57) ABSTRACT

In a laminated heat exchanger with a pair of tank portions formed at one side of each tube element and intake/outlet portions for heat exchanging medium provided at one end in the direction of the lamination or in the direction running at a right angle to the direction of the lamination, a constricting portion for limiting the flow passage cross section is provided in an area in the tank portions where the flow shifts from an even-numbered pass to an odd-numbered pass in a plurality of passes. This allows the heat exchanging medium to flow in sufficient quantities into the tube elements near the outlet side of the partitioning portion, thereby avoiding inconsistency in temperature distribution. This constricting portion, which is formed in the tank group opposite the tank group where the partitioning portion is provided, is provided at the same lamination position as the partitioning portion. The constricting portion may be also formed with a plurality of holes. Thus, by ensuring that heat exchanging medium flows in an even, consistent manner, an improvement in heat exchanging efficiency is achieved.

4 Claims, 12 Drawing Sheets

LAMINATED HEAT EXCHANGER

This is a divisional application of Ser. No. 08/890,755, filed Jul. 11, 1997 which is a divisional of Ser. No. 08/600, 276 filed Feb. 12, 1996.

BACKGROUND OF THE INVENTION

1. Field of the Invention

The present invention relates to a laminated heat exchanger used in the cooling cycle or the like in an air conditioning system for vehicles. The heat exchanger is constituted by laminating tube elements and fins alternately over a plurality of levels and in particular, the present invention relates to a laminated heat exchanger that adopts a structure in which a pair of tank portions are formed at one side of the tube elements and intake/outlet portions for heat exchanging medium are provided at one end in the direction of lamination or at the end surface of the core main body in the direction of the air flow.

2. Description of the Related Art

In order to respond to the demand for miniaturization of heat exchangers and to improve heat exchanging efficiency, applicant has developed the heat exchanger shown in FIGS. 1 and 2, and has conducted much research related to this heat exchanger. In this laminated heat exchanger, a core main body is formed by laminating tube elements alternately with fins 2 over a plurality of levels, a pair of tank portions 12, provided at one side of each tube element, are made to communicate via a U-shaped passage portion 13. A heat exchanging medium flow passage with a plurality of passes is formed in the core main body by providing communication between the tank portions 12 of adjacent tube elements as necessary. Also, intake/outlet portions (intake portion 4 and outlet portion 5) for the heat exchanging medium are provided at one end of the core main body in the direction of the lamination with one of these intake/outlet portions (intake portion 4) being made to communicate with a tank block 21, which constitutes one end of the heat exchanging medium flow passage, through a communicating pipe 30. The other of the intake/outlet portions (outlet portion 5) is made to communicate directly with a tank block 22, which constitutes the other end of the heat exchanging medium flow passage.

The applicant has also conducted various types of research into the one-side tank type laminated heat exchanger that is known in the prior art, as well as the heat exchanger described above. For instance, FIGS. 10 and 11A–B show one such heat exchanger. In this heat exchanger, a core main body is formed by laminating tube elements alternately with fins 2 over a plurality of levels, a pair of tank portions 12, provided at one side of each tube element (toward the bottom in the figures) are made to communicate via a U-shaped passage portion 13 and the tank portions 12 in adjacent tube elements are made to communicate as necessary to form a heat exchanging medium flow passage with a plurality of passes in the core main body. In these aspects, this heat exchanger is similar to the one described earlier. However, this heat exchanger is provided with intake/outlet portions (intake portion 4, outlet portion 5) for heat exchanging medium at the end surface of the core main body in the direction of the air flow.

In these heat exchangers described above, when the heat exchanging medium flows in through one of the intake/outlet portions (intake portion 4), the heat exchanging medium enters the tank block 21 which constitutes one end of the heat exchanging medium flow passage either directly or via the communicating pipe 30. After traveling through a plurality of passes, the heat exchanging medium reaches the tank block 22, which constitutes the other end of the heat exchanging medium flow passage, and it flows out through the other of the intake/outlet portions (outlet portion 5), which communicates with the tank block 22. In this process, the flow of the heat exchanging medium, in which it travels upward or downward through the U-shaped passage portions 13 of the tube elements, is counted as one pass and, for instance, a heat exchanger in which the heat exchanging medium passes through the U-shaped passage portions 13 twice, starting from the tank block constituting one end of the heat exchanging medium flow passage until it reaches the tank block constituting the other end, is referred to as a 4-pass heat exchanger and if it passes through the U-shaped passage portions three times, it is referred to as a 6-pass heat exchanger.

However, in the first type of heat exchanger, i.e., in a 4-pass cooling heat exchanger, in which the heat exchanging medium passes through a tank group without a partitioning portion 18 when it moves from the second pass to the third pass, as shown in FIG. 9A, the coolant tends to flow in the direction that runs at a right angle to the air flow in the structure described above, in which the coolant flows out from one end of the core main body. This results in the coolant collecting in the tube elements close to the outlet (one end in the direction of the lamination). In other words, in the area extending from the third pass through the fourth pass, the coolant does not readily flow toward the side close to the partitioning portion 18 and this has been proved true through testing. The test results are indicated by the broken lines in FIGS. 7 and 8A–B, which demonstrate that the tube temperature and the passing air temperature in the area of the partitioning portion close to the outlet are higher than those in the other areas.

In this context, the tube temperature (TUBU TEMP.) refers to the temperature of the tube element itself and the tube numbers (TUBU No.) in FIGS. 7 and 12 refer to the tube element numbers assigned starting from the left side in FIGS. 1 and 10. Also, the passing air temperature (AIR TEMP.) refers to the temperature of the air that has passed through the area between the tube elements and for which heat exchange has been performed with the fins. The air temperature was measured at a position that is away from the end surface of the core main body on the downstream side by 1~2 cm.

In a 6-pass heat exchanger, the heat exchanging medium flow also concentrates in the area toward the outlet side, away from the partitioning portion 18, as shown in FIG. 9B. As a result, it is assumed that the tube temperature and the passing air temperature in the area of the partitioning portion near the outlet will be different from those in the other areas.

Furthermore, in the latter type of heat exchanger, i.e., a 4-pass cooling heat exchanger, when the flow speed increases with the coolant flow rate per unit time increasing, the coolant will concentrate toward the end in the direction of the lamination when it moves from the second pass through the third pass, as shown in FIG. 14. Also, the coolant will not readily flow in the area toward the partitioning portion 18 in the area extending from the third pass through the fourth pass. The coolant is clearly demonstrated to flow in this manner by the test results indicated with the broken lines in FIG. 12, which show that the passing air temperature is higher in the area near the partitioning portion 18 compared to the other areas.

SUMMARY OF THE INVENTION

Accordingly, the object of the present invention is to provide a laminated heat exchanger in which heat exchanging medium can flow evenly throughout the tube elements without concentrating in any area and with which it is possible to achieve an improvement in heat exchanging efficiency.

The applicant has discovered that concentration of heat exchanging medium in any particular area can be prevented when the heat exchanging medium is made to flow sufficiently through the tube elements near the partitioning portion, which results in nearly consistent temperature distribution in the core main body, by changing the state of the flow of the heat exchanging medium traveling from an even-numbered pass to an odd-numbered pass in the tank group, and the applicant has completed the present invention on the basis of this observation.

In order to achieve the object described above, the laminated heat exchanger according to the present invention is constituted by laminating tube elements, each of which is provided with a pair of tank portions and a U-shaped passage portion communicating between the pair of tank portions, alternately with fins over a plurality of levels, to form a core main body. A heat exchanging medium flow passage with a plurality of passes is formed in the core main body by partitioning tank groups constituted by bonding the tank portions of the tube elements as necessary. Intake/outlet portions for the heat exchanging medium are provided at one end of the core main body in the direction of the lamination with one of the intake/outlet portions being made to communicate with the tank block at one end of the heat exchanging medium flow passage via a communicating pipe and the other of the intake/outlet portions being made to communicate with the tank block constituting the other end of the heating exchanging medium flow passage at one end in the direction of the lamination. A constricting portion, which limits the flow passage cross section is provided in at least one location in the tank group where the flow path shifts from an even-numbered pass to an odd-numbered pass in the plurality of passes.

Consequently, in this structure, the heat exchanging medium flowing in through one of the intake/outlet portions, enters the tank block constituting one end of the heat exchanging medium flow passage via the communicating pipe, reaches the tank block constituting the other end of the heat exchanging medium flow passage after passing through the core main body a plurality of times and flows out from on e end of this tank block in the direction of the lamination via the other of the intake/outlet portions. In this process, in the area where the flow shifts from an even-numbered pass to an odd-numbered pass, the heat exchanging medium tends to flow in greater quantity toward the outlet. However, since a constricting portion for limiting the flow passage cross section is provided in the area of the tank group where the flow shifts from an even-numbered pass (even-numbered path) to an odd-numbered pass (odd-numbered path), the heat exchanging medium flows in sufficient quantity through the tube elements near the outlet in the partitioning portion as through the other tube elements, due to the reduced flow speed caused by the constricting portion and the like. With this, as indicated with the solid lines in FIGS. 7 and 8A–B, large discrepancies in temperature distribution are eliminated, thus achieving the object described above.

Alternatively, another laminated heat exchanger which achieves the same object may be constituted by laminating tube elements, each of which is provided with a pair of tank portions at one side and a U-shaped passage portion communicating between the pair of tank portions, alternately with fins over a plurality of levels to form a core main body, with a heat exchanging medium flow passage that includes a plurality of passes formed in the core main body by partitioning tank groups constituted by bonding adjacent tank portions as necessary. Intake/outlet portions through which the heat exchanging medium flows in and out are provided in the tank blocks constituting the two ends of this heat exchanging medium flow passage in the direction running at a right angle to the direction of the lamination and a constricting portion for limiting the flow passage cross section is provided in at least one location in the tank group where the flow shifts from an even-numbered pass to an odd-numbered pass in the plurality of passes. Specifically, in this structure, the intake/outlet portion may be provided at the end surface of the tank block in the direction of the air flow (the front surface of the core main body, for instance).

In this structure, the heat exchanging medium which has flowed in through one of the intake/outlet portions, enters the tank block constituting one end of the heat exchanging medium flow passage, reaches the tank block constituting the other end of the heat exchanging medium flow passage after passing through the core main body a plurality of times and flows out via the other of the intake/outlet portions. During this process, in the area where the flow shifts from an even-numbered pass to an odd-numbered pass, the heat exchanging medium tends to flow in a concentrated manner away from the even-numbered pass if the flow speed is high. However, since the constricting portion for limiting the flow passage cross section is provided in the area of the tank group where the flow shifts from an even-numbered pass (even-numbered path) to an odd-numbered pass (odd-numbered path), the heat exchanging medium flows in sufficient quantity through the tube elements near the partitioning portions as through the other tube elements due to the reduced flow speed caused by the constricting portion and the like. Thus, as indicated with the solid lines in FIG. 12, there is no great discrepancy in the temperature distribution, thus achieving the object described earlier.

In this structure, the constricting portion is formed in the tank group opposite the tank group which is provided with the partitioning portion and it is desirable to provide the constricting portion at the position which corresponds to the position in the lamination where the partitioning portion is provided in the tank group. In addition, the constricting portion may be constituted with a plurality of holes.

While the form of the constricting portion may include many variations, it has been confirmed that, in a given area, a two-hole configuration rather than one hole, provides greater consistency in temperature distribution and, by adjusting the number of holes, their shape and size as necessary, it is possible to achieve subtle adjustments while maintaining a temperature distribution that is practically consistent. In addition, it is necessary to set an appropriate constricting portion in relation to the pressure loss and the quantity of heat discharge from the core main body. If the cross section area of the constricting portion is too small, it results in a greater pressure loss with reduced quantity of heat discharge, while if the cross sectional area of the constricting portion is too large, the pressure loss is reduced but uneven distribution of the heat exchanging medium, which is the problem in the prior art, becomes more pronounced. Because of this, it is desirable that the cross section area S1 of the constricting portion and the cross sectional area S2 of the through holes communicating between the tank portions maintain a relationship expressed as $0.25 \leqq S1/S2 \leqq 0.80$.

BRIEF DESCRIPTION OF THE DRAWINGS

The above and other features of the invention and the concomitant advantages will be better understood and appreciated by persons skilled in the field to which the invention pertains in view of the following description provided in conjunction with the accompanying drawings which illustrate preferred embodiments. In the drawings.

DETAILED DESCRIPTION OF THE PREFERRED EMBODIMENTS

Figure 1:
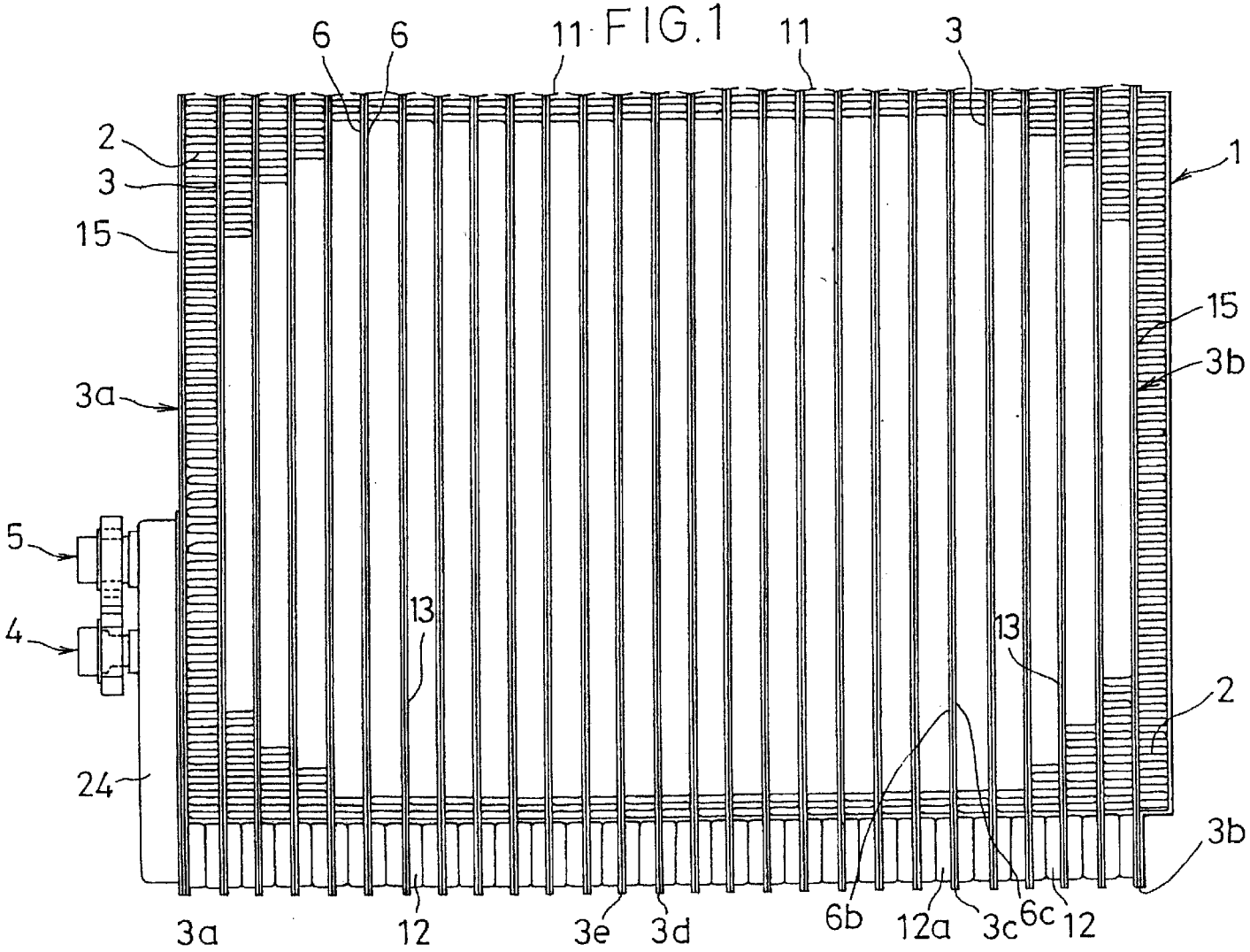
FIG. 1 shows an end surface which is at a right angle to the direction of the air flow in a heat exchanger which is the first mode of the laminated heat exchanger according to the present invention.
Figure 2B:
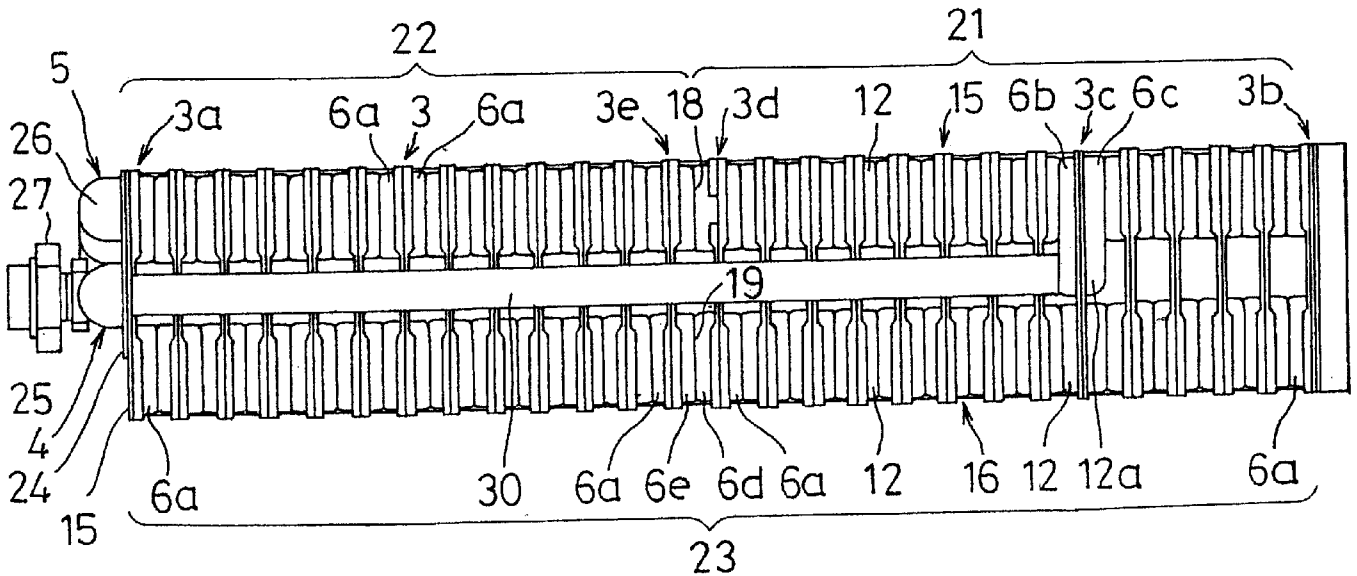
FIG. 2B shows the bottom surface of the laminated heat exchanger shown in FIG. 1.
Figure 2A:
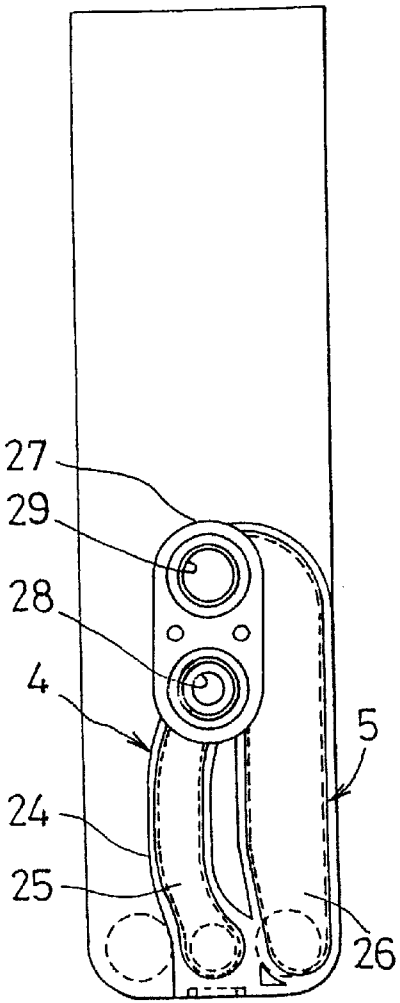
FIG. 2A shows a side surface of the laminated heat exchanger shown in FIG. 1 where the intake/outlet portions are provided.

The following is an explanation of embodiments of the present invention in reference to the drawings. In FIGS. 1 and 2, a laminated heat exchanger 1 is a 4-pass type evaporator, for instance, with its core main body formed by laminating fins 2 and tube elements 3 alternately over a plurality of levels and an intake portion 4 and an outlet portion 5 for heat exchanging medium provided at one end in the direction of the lamination of the tube elements 3. All of the tube elements 3, except for tube elements 3*a* and 3*b* at the two ends in the direction of the lamination, the tube element 3*c* provided with an extended tank portion which is to be explained later, the tube element 3*d* located approximately at the center and the tube element 3*e*, which is adjacent to the tube element 3*d*, are each constituted by bonding two formed plates 6*a*, one of which is shown in FIG. 3A.

The formed plate 6*a* is formed by press machining an aluminum plate with two bowl-like distended portions for tank formation 7 formed at one end, a distended portion for passage formation 8, an indented portion 9 for mounting a communicating pipe, which is to be explained later, formed between the distended portions for tank formation and a projection 10 extending from the area between the two distended portions for tank formation 7 to the area close to the other end of the formed plate 6*a*, formed in the distended portion for passage formation 8. In addition, at the other end of the formed plate 6, a projected tab 11 (shown in FIG. 1) is provided for preventing the fins 2 from falling out during the assembly which precedes the brazing operation.

The distended portions for tank formation 7 are made to distend more than the distended portion for passage formation 8 and the projection 10 is formed so as to lie on the same plane as the bonding margin at the edge of the formed plate. When two formed plates 6*a* are bonded at their edges, their projections 10 are also bonded so that a pair of tank portions 12 are formed with the distended portions for tank formation 7 that face opposite each other and a U-shaped passage portion 13 for communicating between the tank portions is formed with the distended portions for passage formation 8 that face opposite each other.

Figure 3C:
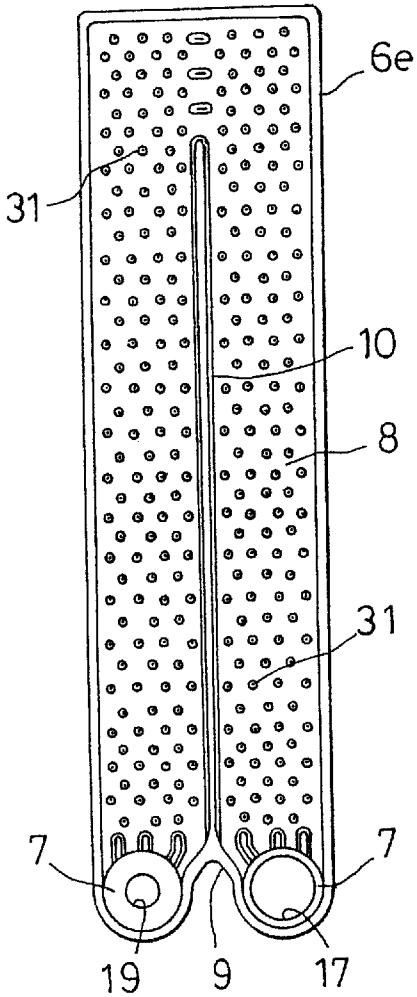
FIGS. 3A–3C show formed plates constituting the tube elements used in the laminated heat exchanger, with FIG. 3A showing a normal formed plate, FIG. 3B showing a formed plate provided with a partitioning portion, and FIG. 3C showing a formed plate provided with a constricting portion.
Figure 3B:
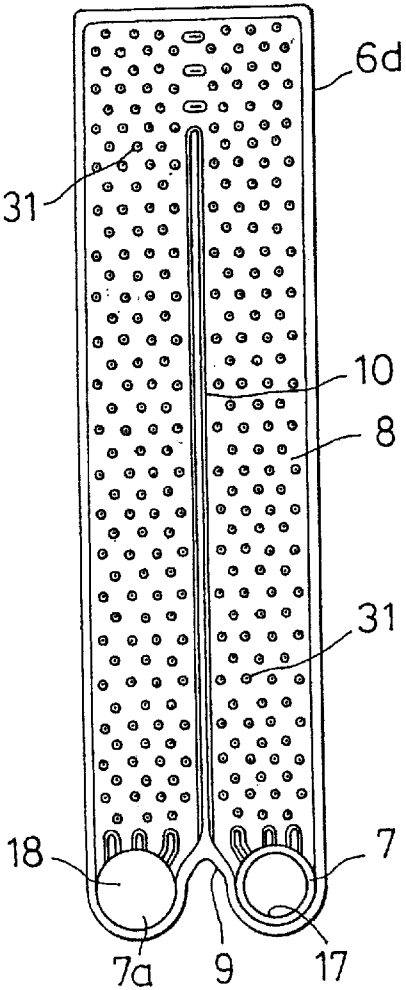
Figure 3A:
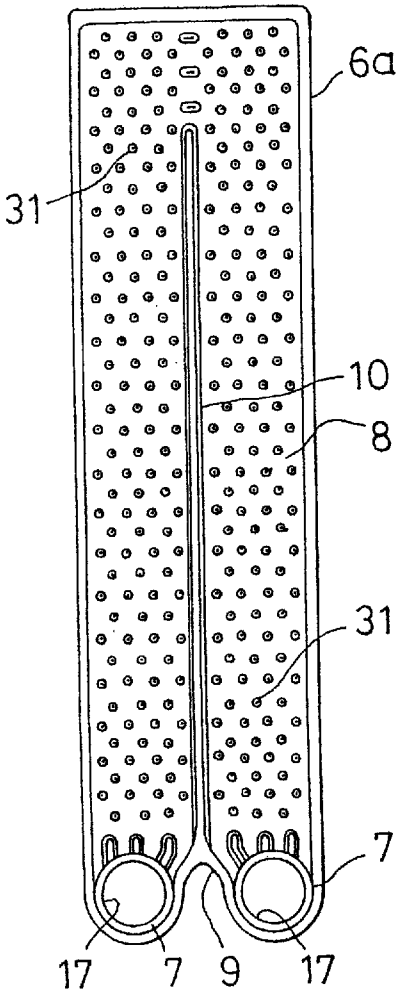

The tube elements 3*a* and 3*b* at the two ends in the direction of the lamination are each constituted by bonding a flat plate 15 to a plate 6*a*, as illustrated in FIG. 3A.

In the formed plates 6*b* and 6*c* constituting the tube element 3*c*, one of the distended portions for tank formation extends so as to approach the other distended portion for tank formation. As a result, in the tube element 3*c*, a tank portion 12, the size of which is the same as that in the tube element 3 mentioned earlier, and a tank portion 12*a*, which is made to extend into and fill the indented portion, are formed. Other structural features, i.e., the distended portion for passage formation 8 formed continuous to the distended portions for tank formation, the projection 10 formed extending from the area between the distended portions for tank formation to the area close to the other end of the formed plate and the projected tab 11 are identical to those in the formed plate 6 shown in FIG. 3A and their explanation is omitted here.

In the heat exchanger, as shown in FIG. 1, adjacent tube elements are abutted at the tank portions to form two tank groups, i.e., a first tank group 15 and a second tank group 16 which extend in the direction of the lamination (at a right angle to the direction of the air flow) and in the one tank group 15, which includes the extended tank portion 12*a*, all the tank portions are in communication via the through holes 17 formed in the distended portions for tank formation 9, except for the formed plate 6*d* which is located at approximately the center in the direction of the lamination. In the other tank group 16, all the tank portions are in communication via the through holes 17, without any partition.

The tube element 3*d* is constituted by combining the formed plate 6*a* shown in FIG. 3A and the formed plate 6*d* shown in FIG. 3B with the formed plate 6*d*, not provided with a through hole in one of its distended portions for tank formation 7*a*, and a partitioning portion 18 to partition one of the tank groups, i.e., the tank group 15, which is formed with this non-communicating portion. Note that the partitioning portion 18 may be constituted by having the adjacent tube element 3*e*, as a blind tank, which does not have a through hole, and by bonding the distended portions for tank formation without through holes in order to increase the strength. Alternatively, it may have a structure in which, instead of a blind tank, a thin plate is enclosed between the tube element 3*d* and the tube element 3*e* to close off the through holes communicating between the tank portions.

In addition, the tube element 3*e* is constituted by combining the formed plate 6*a* shown in FIG. 3A and the formed plate 6*e* shown in FIG. 3C, with a constricting portion 19, for limiting the communicating portion of the tank group 16 located opposite from the tank group 15 where the partitioning portion 18 is provided, in the formed plate 6*e*, which is on the side where it is bonded with the tube element 3*d*. As a result, the first tank group 15 is partitioned into a first tank block or first tank subgroup 21 that includes the extended tank portion 12*a*, and a second tank block or fourth tank subgroup 22 that communicates with the outlet portion 5 by the partitioning portion 18, while the non-partitioned second tank group 16 constitutes a third tank block 23 that includes a second tank subgroup and a third tank subgroup, which is provided with the constricting portion 19. Note that the first and second subgroups are disposed on opposite sides of the heat exchanger and fluidly communicate via the U-shaped passage portions 13. In this embodiment, the tube elements are laminated over 27 levels with the tube element 3*c* positioned at the 6th level, the tube element 3*d* positioned at the 14th level and the tube element 3*e* positioned at the 15th level, counting from the right in the figure.

Figure 4A:
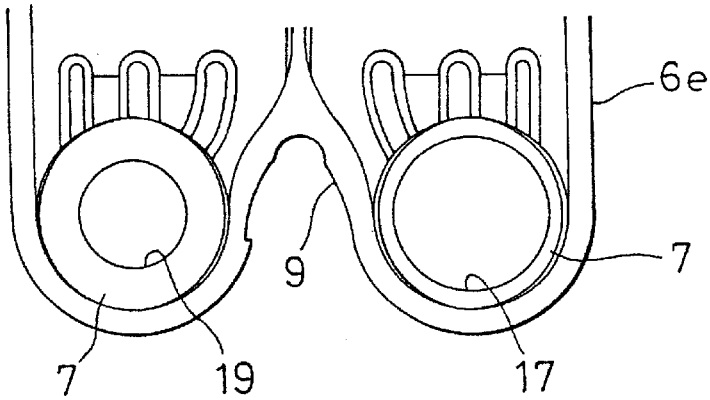
FIGS. 4A–D, FIGS. 5A–5F and FIGS. 6A–6E show variations of the constricting portion.
Figure 4B:
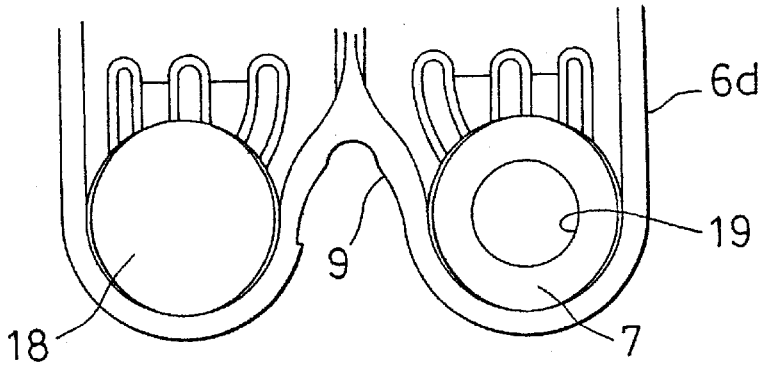

The constricting portion 19 is constituted of, for instance, one round hole with the flow passage cross section area (the size of the through hole 17) being reduced compared to that in the other areas, as shown in FIG. 4A. In this embodiment, the diameter of the regular through hole 17 is set at 15.7 mm and the diameter of the constricting portion is set at 12 mm, and the constricting portion 19 is provided in the formed plate 6*e*. However, the constricting portion may be provided at the formed plate 6*d*, where the partitioning portion 18 is formed, as shown in FIG. 4B, or it may be provided at both the formed plates 6*d* and 6*e* in order to achieve increased strength.

Figure 13:
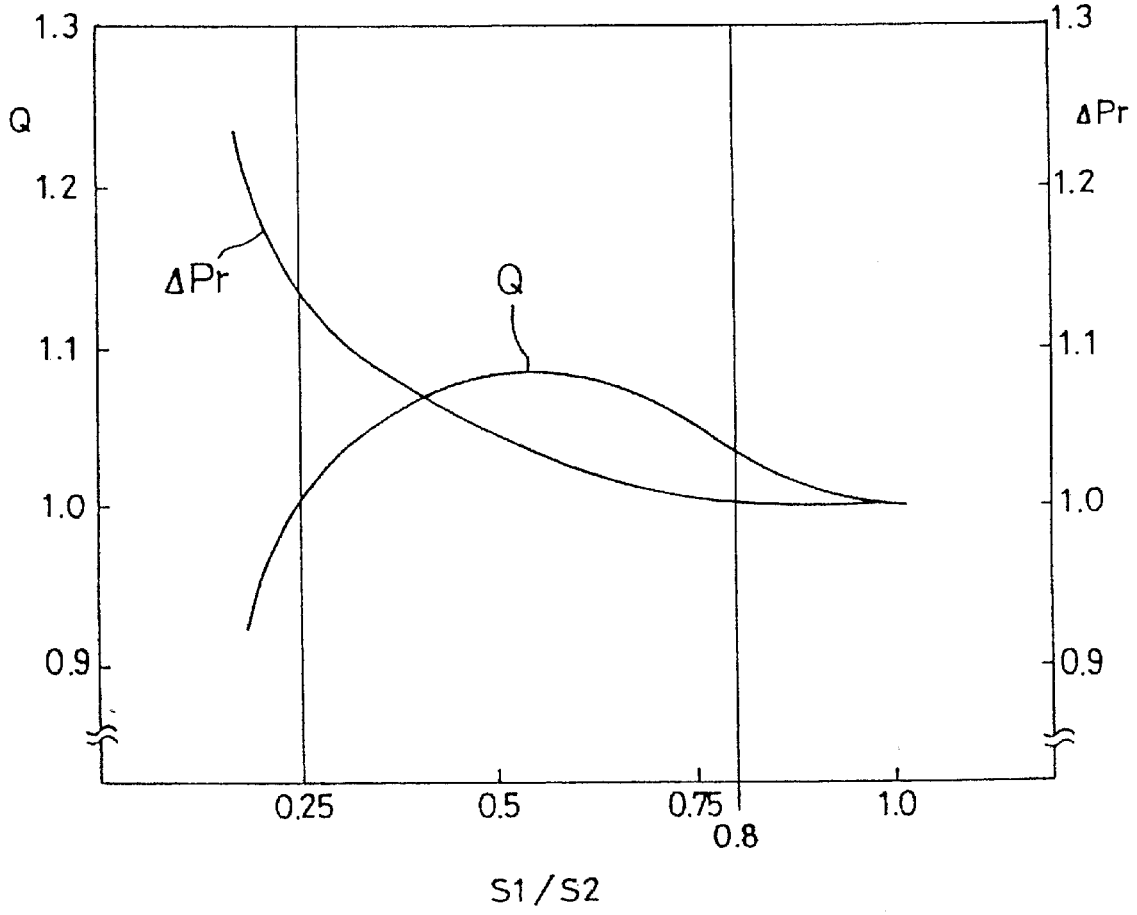
FIG. 13 is a characteristics diagram representing the quantity of heat discharge Q from the core main body the pressure loss Δ Pr relative to the ratio of the cross section area S1 of the constricting portion and the cross section area S2 of the through holes communicating between the tank portions.
Figure 14:
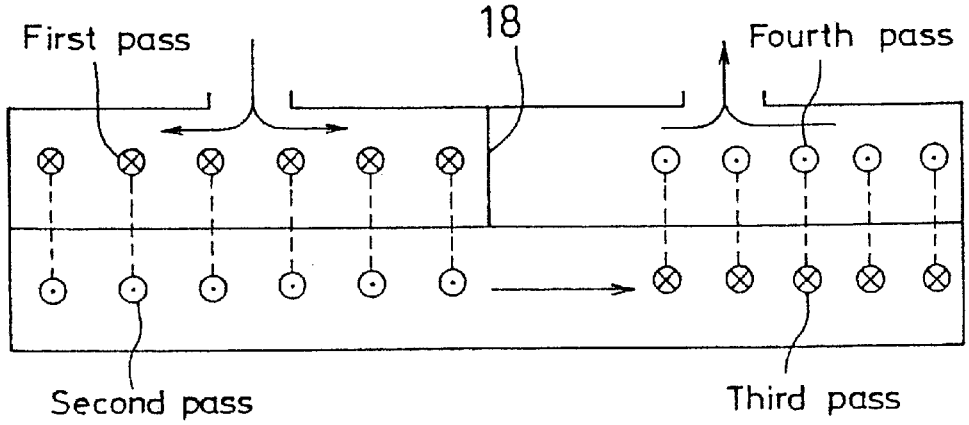
FIG.14 Prior Art
FIG. 14 is a conceptual diagram illustrating the flow of heat exchanging medium in a prior art 4-pass laminated heat exchanger provided with intake/outlet portions provided at the end surface of the core main body in the direction of the air flow but not provided with a constricting portion.

However, if the cross section area of the constricting portion 19 is too small, the passage resistance becomes great, increasing the pressure loss Δ Pr and resulting in reduced heat discharge (heat exchange quantity) Q due to the reduction in the flow rate of the heat exchanging medium (see FIG. 13). However, if the cross section area of the constricting portion 19 is made too large, inconsistency in the distribution of the heat exchanging medium, which is the problem in the prior art, becomes more pronounced. Thus, in order to avoid these problems, it is desirable to set the size of the constricting portion 19 within a range in which the cross sectional area S1 of the constricting portion 19 and the cross sectional area S2 of the through holes 17 maintain the relationship expressed as $0.25 \leqq S1/S2 \leqq 0.80$. Consequently, when the size of the through hole is at 15.7 mm, as in this embodiment, it is desirable to form the constricting portion within the range of approximately 8~14 mm.

Now, the intake portion 4 and the outlet portion 5, which are provided at one end in the direction of the lamination on the side which is further from the extended tank portion 12*a*, are constituted by bonding a plate for intake/outlet passage formation 24 to the flat plate 15 mentioned earlier, which constitutes an end plate, and are provided with an intake passage 25 and an outlet passage 26 respectively, formed to extend from approximately the middle of the plate 15 in the direction of the length toward the tank portions.

At the upper portion of the intake passage 25 and the outlet passage 26, an inflow port 28 and an outflow port 29 respectively are provided via a coupling 27 which secures an expansion valve. The intake passage 25 and the extended tank portion 12*a* are in communication with each other through a communicating passage constituted with a communicating pipe 30, which is secured in the indented portion 9 and is bonded to the hole formed in the plate 15 and a hole formed in the formed plate 6*b*. The second tank block 22 and the outlet passage 26 communicate with each other via a hole formed in the plate 15.

Thus, in the heat exchanger structured as described above, heat exchanging medium which has flowed in through the intake portion 4 enters the extended tank portion 12*a* through the communicating pipe 30, is then dispersed over the entirety of the first tank block 21 and then travels upward through the U-shaped passage portions 13 of the tube elements that correspond to the first tank block 21 along the projections 10 (first pass). Then, the heat exchanging medium makes a U-turn above the projections 10 before starting to travel downward (second pass) and it reaches the tank group on the opposite side (third tank block 23). After that, the heat exchanging medium moves horizontally to the remaining tube elements which constitute the third tank block 23 and travels upward through the U-shaped passage portions 13 of the tube elements along the projections 10 (third pass). Next, it makes a U-turn above the projections 10 before travelling downward (fourth pass) and is then led to the tank portions constituting the second tank block 22 before flowing out through the outlet portion 5. Because of this, the heat of the heat exchanging medium is communicated to the fins 2 during the process in which it flows through the U-shaped passage portions 13 constituting the first~fourth passes, so that heat exchange is performed with the air passing between the fins.

Figure 7:
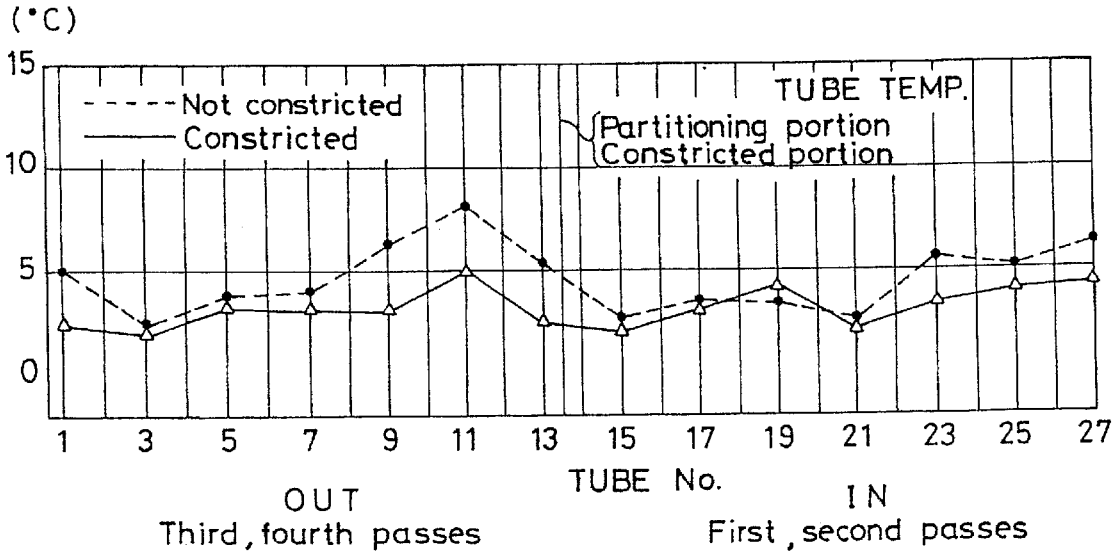
FIG. 7 is a characteristics diagram showing the temperature of the tube elements in the laminated heat exchanger.
Figure 8A:
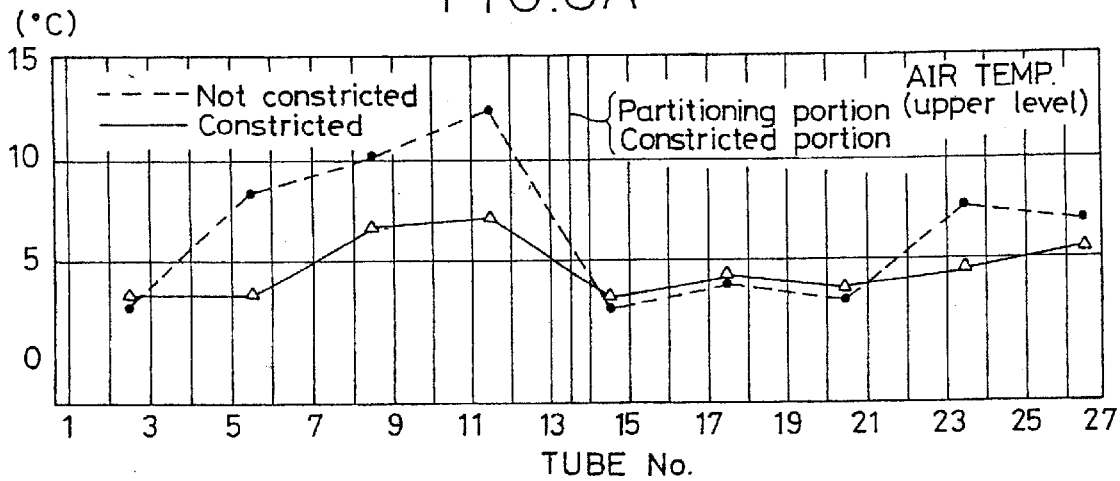
FIG. 8A is a characteristics diagram showing the temperature of the air passing through the upper portion of the laminated heat exchanger in the first mode.
Figure 8B:
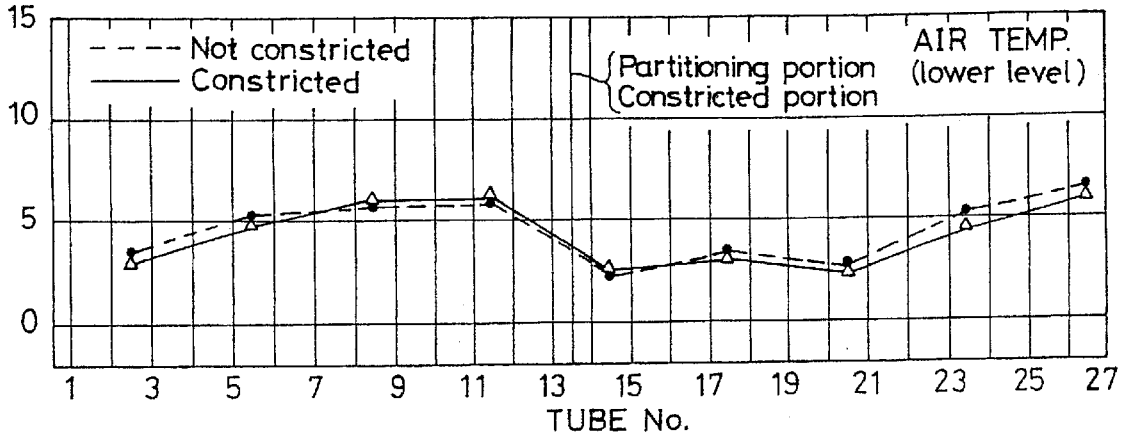
FIG. 8B is a characteristics diagram showing the temperature of the air passing through the lower portion of the laminated heat exchanger in the first mode.
Figure 9A:
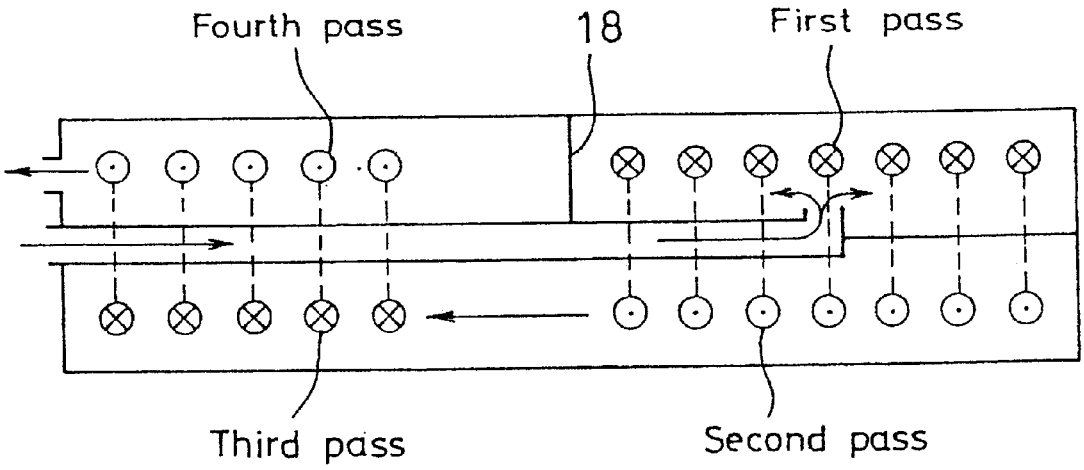
FIG.9A Prior Art
FIG. 9A is a conceptual diagram illustrating the flow of heat exchanging medium in a prior art 4-pass laminated heat exchanger, provided with intake/outlet portions for the heat exchanging medium at one end of the core main body in the direction of the lamination which is not provided with a constricting portion.
Figure 9B:
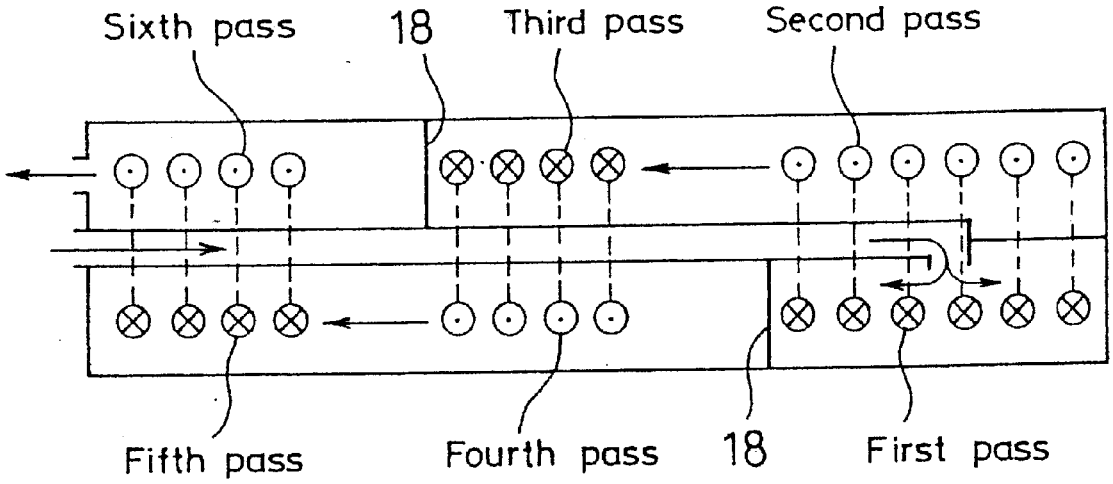
FIG.9B Prior Art
FIG. 9B is a conceptual diagram illustrating the flow of heat exchanging medium in a prior art 6-pass laminated heat exchanger without a constricting portion.

During this process, since the outlet portion 5 is connected to the second tank block 22 via the end of the core main body in the direction of the lamination, the flow of the heat exchanging medium moving from the second pass to the third pass would tend to concentrate toward the outlet portion as described earlier, and this might be of concern. However, with the constricting portion 19 formed in the communicating area in the third tank group 23, the heat exchanging medium is made to flow in sufficient quantity into the tube elements near the partitioning portion, among all the tube elements constituting the third and fourth passes. Such a change in the flow of coolant, effected by providing the constricting portion 19, is assumed to be caused by the fact that the flow speed of the heat exchanging medium moving to the third pass is restricted by the constricting portion 19 and also the complex flow pattern being created with the prevention of a linear flow of the heat exchanging medium inside the second tank group 16. In any case, according to the results of tests in which the tube temperature and the passing air temperature were measured, as shown in FIG. 7 and FIGS. 8A–B, the temperature of the tube elements in the partitioning portion near the outlet (in particular TUBU Nos. 9~13) and the temperature of the air passing through the upper level of the tube elements (in particular TUBU Nos. 5~13) are lower than those in a prior art heat exchanger without a constricting portion, as indicated with the solid lines, achieving a consistent temperature distribution overall, and this proves that heat exchanging medium (coolant) flow is practically consistent over the entirety of the core main body without significant concentration in any particular area.

Figure 4C:
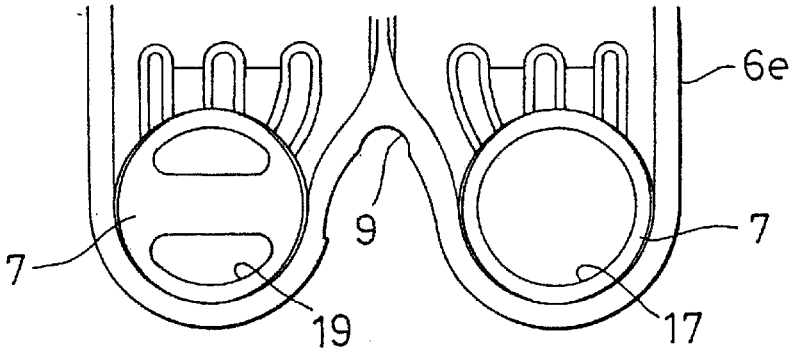
Figure 4D:
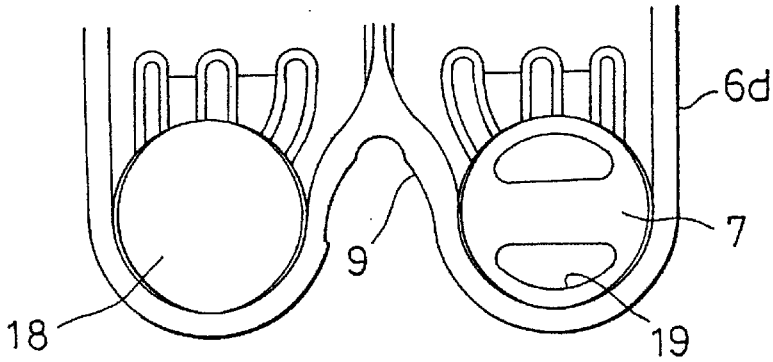

It has been confirmed that the temperature distribution changes subtly depending upon the shape of, and the number of holes in the constricting portion 19 mentioned above, whereby the flow passage area is made smaller relative to the other through holes 17. Even when the constricting portion 19 in the distended portion for tank formation 7 of the formed plate 6*d* provided with the partitioning portion 18 or the formed plate 6*e* adjacent to it, as shown in FIG. 4C or 4D, is made by forming holes symmetrically at two positions, in an upper area and a lower area, for instance, with the total area of the constricting portion remaining the same, the temperature in the partitioning portion near the outlet (the tube temperature and the passing air temperature) can be further kept down, thereby further smoothing the temperature distribution in core main body.

Figure 5A:
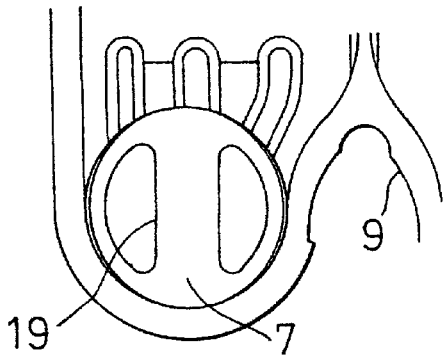
Figure 5D:
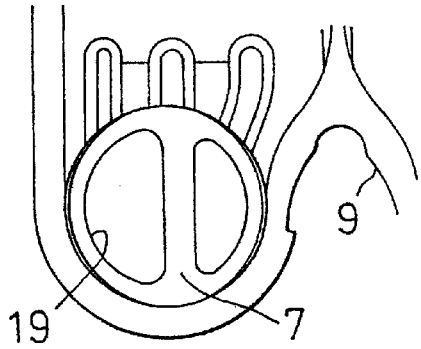
Figure 5B:
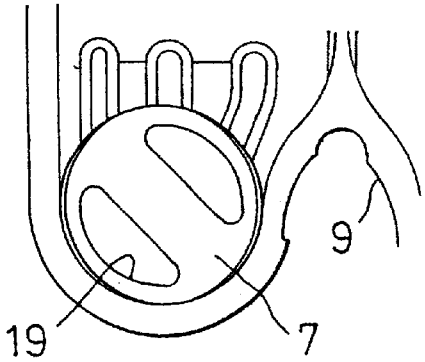

In addition, the constricting portion 19 is not limited to those described above and it may be constituted by forming two symmetrical holes at two locations, left and right in the distended portion for tank formation in the formed plate 6*d* provided with the partitioning portion 18 or the formed plate 6*e* adjacent to it, as shown in FIG. 5A, or it may be constituted by forming two symmetrical holes relative to a hypothetical line which inclines at approximately 45°, as shown in FIG. 5B.

Figure 5E:
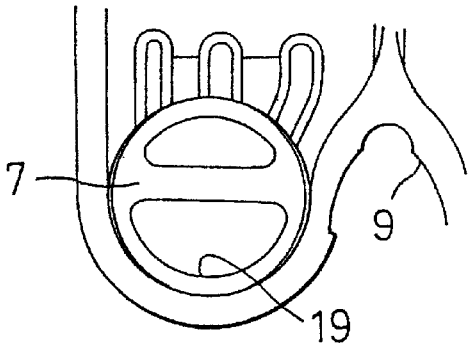
Figure 5C:
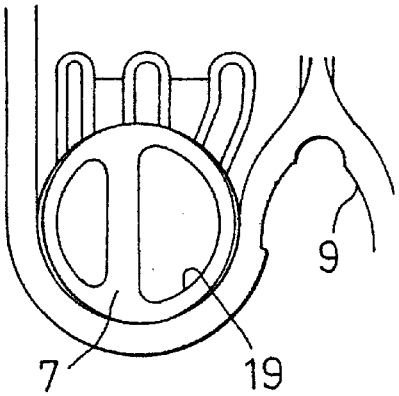
Figure 5F:
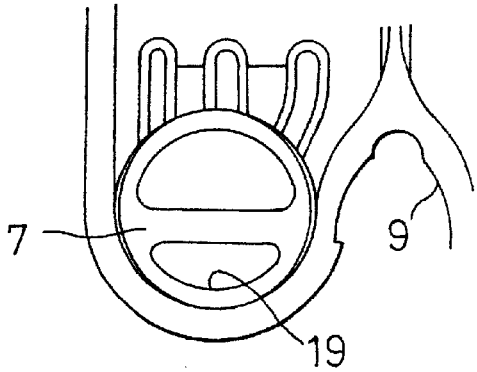

The structure in which the constricting portion 19 is constituted with two holes also may include a configuration in which the two holes formed at the left and right in the distended portion for tank formation in the formed plate provided with the partitioning portion 18 or the formed plate adjacent to it, are not equal in size, as shown in FIG. 5C or FIG. 5D, or two holes of different sizes may be formed above and below each other at two positions in the distended portion for tank formation, as shown in FIG. 5E or FIG. 5F.

Figure 6A:
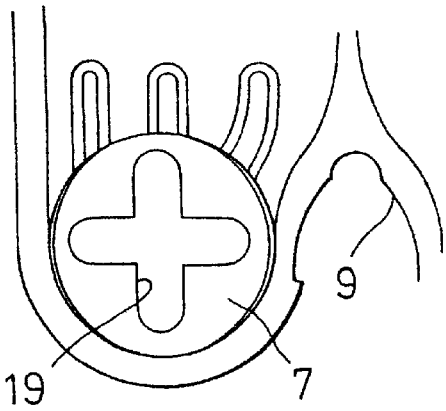
Figure 6B:
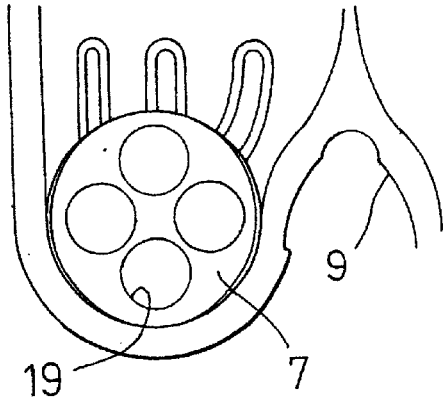
Figure 6C:
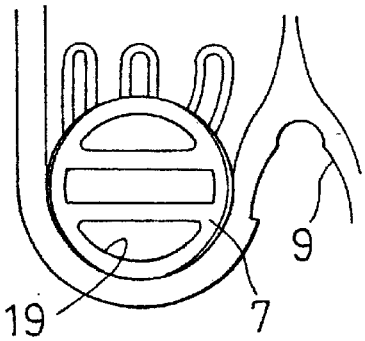
Figure 6D:
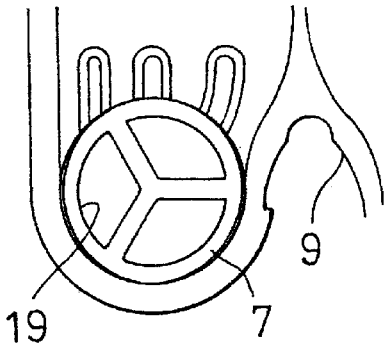
Figure 6E:
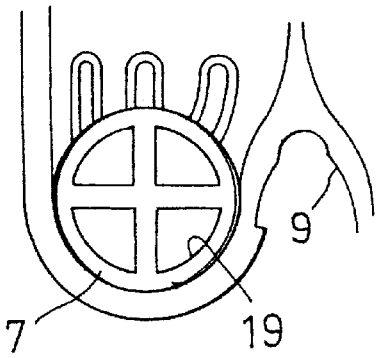

Further variations in the shape of the constricting portion 19 for limiting the flow passage area are conceivable and, as shown in FIG. 6A, the hole may be cross-shaped or, as shown in FIG. 6B, the constricting portion 19 may take a form in which small holes are provided at four locations, up, down, left and right. Furthermore, as shown in FIG. 6C, holes may be provided at three positions, i.e., in the upper, middle and lower parts of the distended portion for tank formation or, as shown in FIG. 6D, the constricting portion 19 may be constituted with three holes that are three sections of a circle created by dividing a circular hole into three approximately equal segments with their central angles approximately the same. Moreover, as shown in FIG. 6E, it may be constituted with four holes that are four sections of a circle divided into four equal segments with their central angles approximately the same.

In any of these forms, as long as the cross sectional area (when the constricting portion is constituted with a plurality of holes, the total area of the cross sectional areas of the holes) S1 of the constricting portion 19 and the cross sectional area S2 of the through holes 17 retain the relationship expressed as $0.25 \leqq S1/S2 \leqq 0.80$, the advantages described earlier are achieved.

Figure 10:
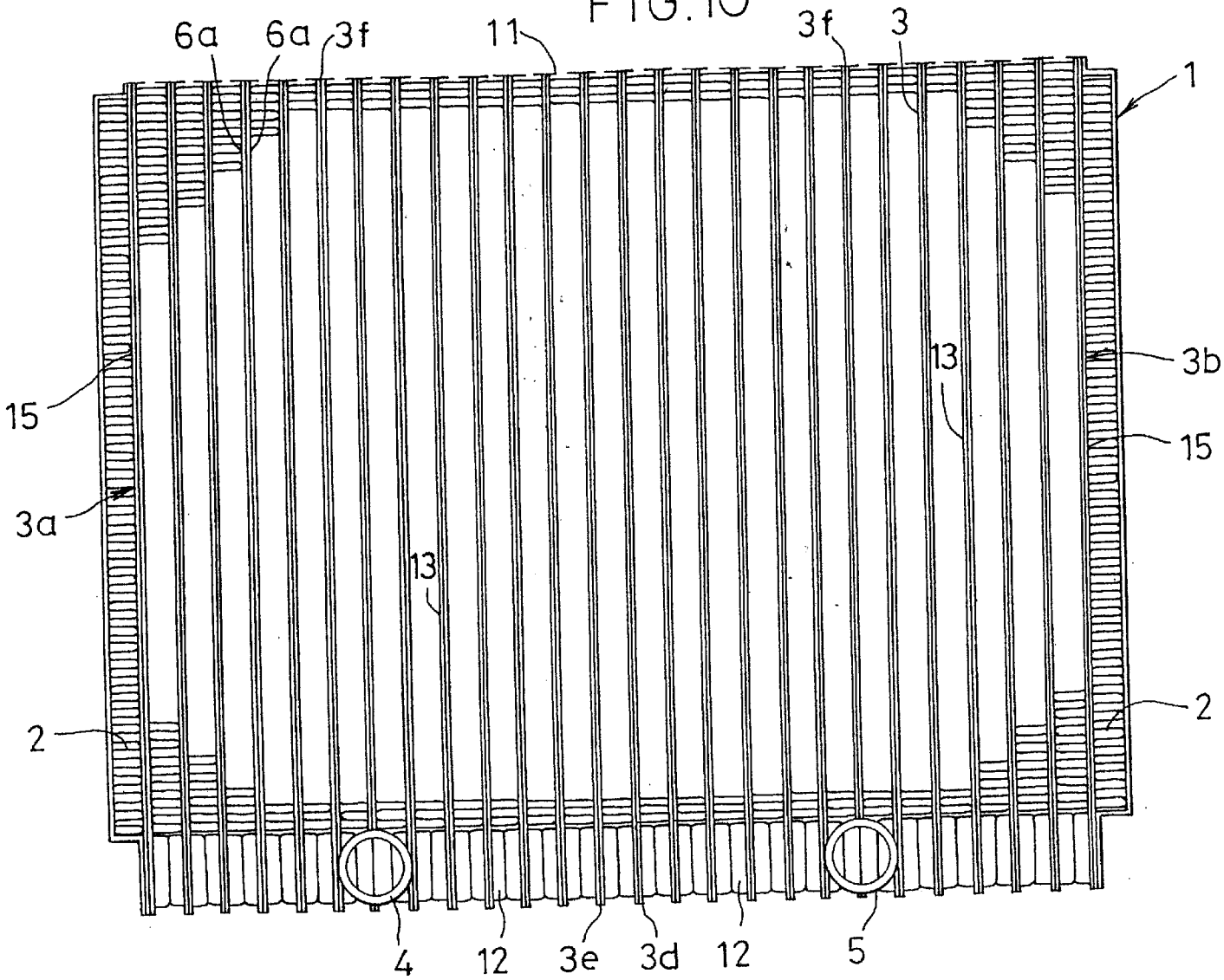
FIG. 10 shows the end surface which is at a right angle to the direction of the air flow in a laminated heat exchanger, which is the second mode of the laminated heat exchanger according to the present invention.
Figure 11B:
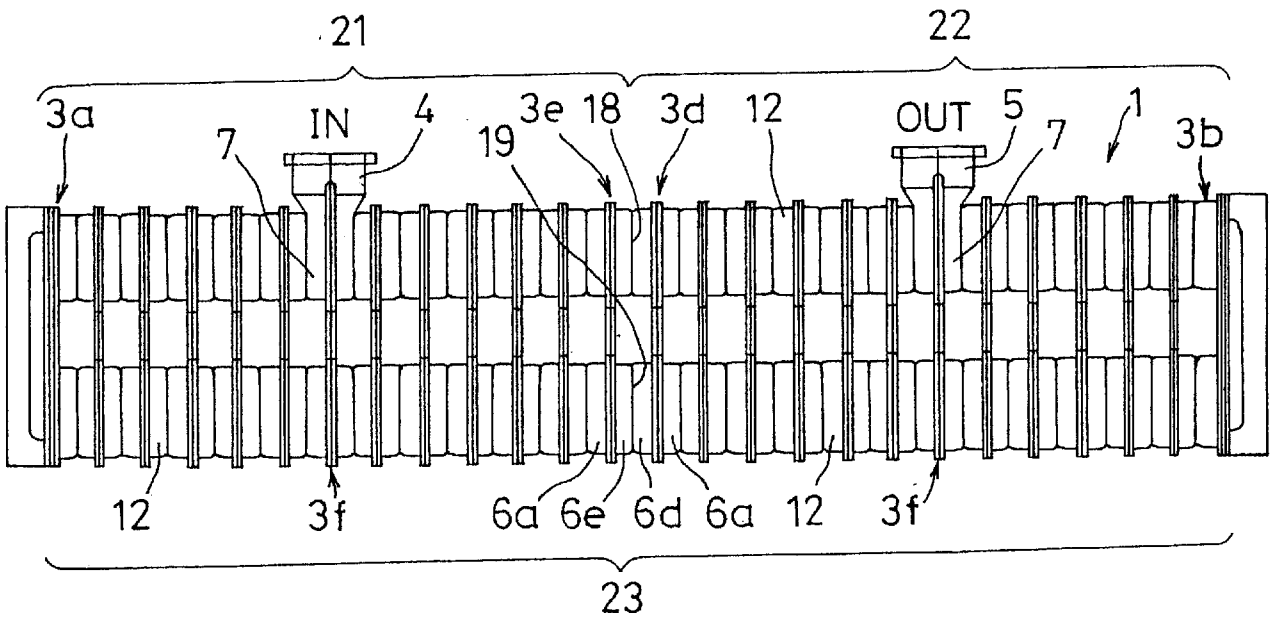
FIG. 11B shows the bottom surface of the laminated heat exchanger shown in FIG. 10.
Figure 11A:
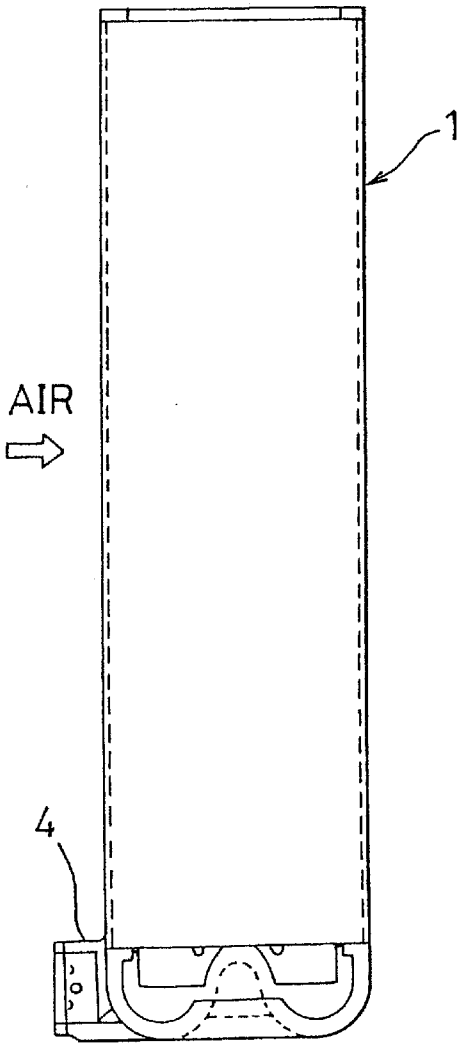
FIG. 11A shows the side surface of the laminated heat exchanger shown in FIG. 10.

Another embodiment of the present invention is shown in FIGS. 10 and 11A–B and mainly, the aspects of it that are different from those in the previous embodiment are explained below, with the same reference numbers assigned to components which are identical to those in all the drawings.

This laminated heat exchanger is a 4-pass type evaporator, for instance, with an intake portion 4 and an outlet portion 5 for heat exchanging medium provided at an end surface of the core main body in the direction of the air flow, specifically at the end surface on the upstream side. All the tube elements 3, except for the tube elements 3*a* and 3*b* at the two ends in the direction of the lamination, the tube element 3*d* located at approximately the center, the tube element 3*e* adjacent to it and tube elements 3*f*, each of which is formed as a unit with the intake portion 4 or the outlet portion 5, are constituted by bonding together two formed plates 6*a*, one of which is shown in FIG. 3A.

As all the tube elements except for the tube elements 3*f* are structured identically to those described earlier, their explanation is omitted here. In each tube element 3*f*, the distended portion for tank formation 7 on the upstream side projects out and opens in the direction of the air flow and, as a result, in the tube elements 3*f*, the intake portion 4 or the outlet portion 5 is formed by bonding this portion that projects out and opens, face-to-face. The other structural features, i.e., the distended portion for passage formation formed continuous to the distended portions for tank formation, the projection formed extending from the area between the distended portions for tank formation through the area near the other end of the formed plate and the projected tab for preventing the fins 2 from falling out provided at the other end of the formed plate are identical to those in the formed plate 6 shown in FIG. 3A and their explanation is omitted here.

In addition, the partitioning portion 18 and the constricting portion 19 provided on the opposite side from the partitioning portion 18, are structured identically to those described earlier. However, in this heat exchanger, the tube elements are laminated over 26 levels with the intake portion 4 formed at the 7th level and the outlet portion formed at the 20th level from the left in the figure, and the partitioning portion 18 and the constricting portion 19 formed between the 7th level (tube element 3*e*) and the 14th level (tube element 3*d*) counting from the left. In this heat exchanger, the partitioning portion 18 and the constricting portion 19 may be formed between the 14th level and the 15th level from the left instead.

As shown in FIG. 4A, the constricting portion 19 may be constituted by forming one round hole whose flow passage cross section is constricted in the formed plate 6*e*, for instance. Alternatively, this round hole may be provided in the formed plate 6*d*, where the partitioning portion 18 is formed, as shown in FIG. 4B, or a round hole may be provided in both of the formed plates 6*d* and 6*e* for increased strength. In addition, while the diameter of the round hole is set at 12 mm against the diameter of the regular through hole 17 which is set at 15.7 mm, it is desirable to set the cross sectional area of this constricting portion within the range in which the cross sectional area S1 of the constricting portion 19 and the cross sectional area S2 of the through hole 17 retain the relationship expressed as $0.25 \leqq S1/S2 \leqq 0.80$ by taking into consideration the relationship illustrated in FIG. 13, as explained earlier and when the size of the through hole is at 15.7 as in this embodiment, the constricting portion 19 may be formed within the range of approximately 8~14.

Consequently, in the heat exchanger structured as described above, heat exchanging medium which has flowed in through the intake portion 4 is distributed over the entirety of the first tank block 21 and it then travels upward through the U-shaped passage portions 13 of the tube elements that correspond to the first tank block 21 along the projections 10 (first pass). Then, it makes a U-turn above the projections 10 before travelling downward (second pass) to reach the tank group (third tank block 23) on the opposite side. After this, the heat exchanging medium moves horizontally to the remaining tube elements constituting the third tank block 23 and travels upward through the U-shaped passage portions 13 of the tube elements along the projections 10 (third pass). Then it makes a U-turn above the projections 10 before travelling downward (fourth pass) and is then led to the tank portions constituting the second tank block 22 before flowing out through the outlet portion 5. Because of this, the heat of the heat exchanging medium is communicated to the fins 2 during the process in which it flows through the U-shaped passage portions 13 constituting the first~fourth passes so that heat exchange is performed with the air passing between the fins.

Figure 12A:
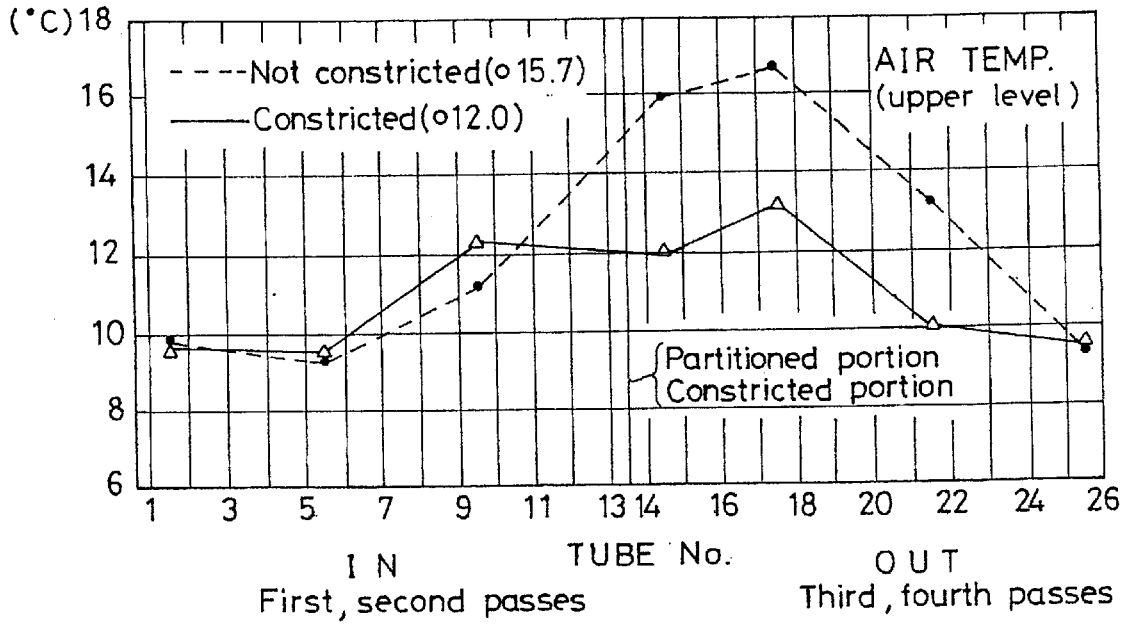
FIG. 12A is a characteristics diagram showing the temperature of the air passing through the upper portion of the laminated heat exchanger in the second mode.
Figure 12B:
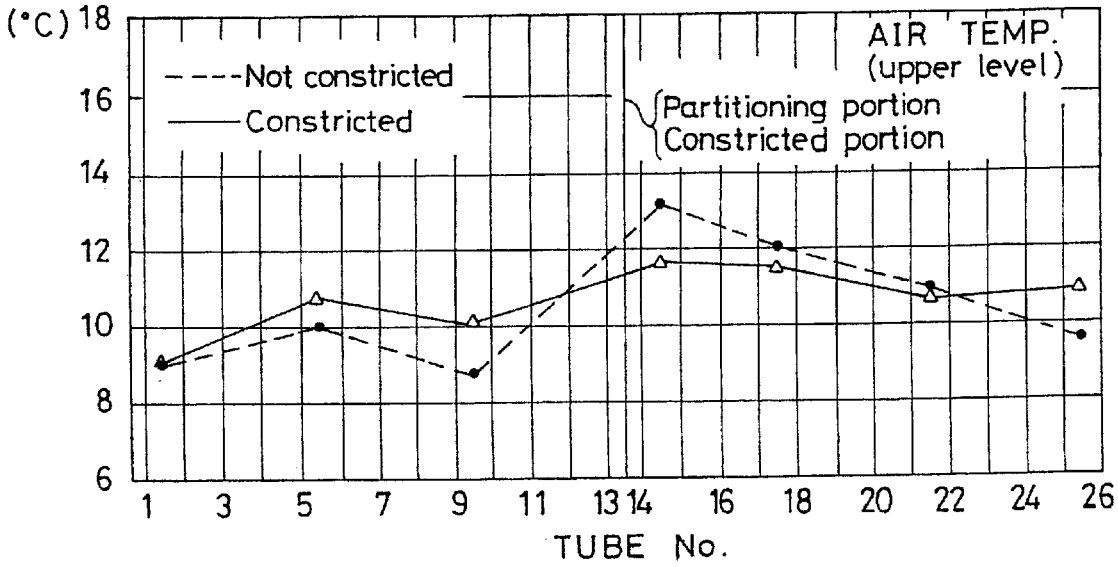
FIG. 12B is a diagram showing the temperature of the air passing through the lower portion of the heat exchanger in the second mode.

During this process, the flow of the heat exchanging medium moving from the second pass to the third pass tends to concentrate toward the outlet portion as described earlier and this might be of concern. However, with the constricting portion 19 formed in the communicating area in the third tank group 23, the heat exchanging medium is made to flow in sufficient quantity into the tube elements near the partitioning portion, too, among all the tube elements constituting the third and fourth passes. Such a change in the flow of coolant effected by providing the constricting portion 19 is assumed to be caused by fact that the flow speed of the heat exchanging medium moving to the third pass is reduced by the constricting portion 19 and also the complex flow pattern being created with the prevention of a linear flow of the heat exchanging medium inside the second tank group 16. In any case, according to the results of tests in which the passing air temperature was measured, shown in FIG. 12, the temperature of the air passing between the tube elements of the partitioning portion near the outlet (in particular TUBU Nos. 14~20) is lower than that in a heat exchanger without a constricting portion in the prior art, as indicated with the solid line, achieving consistent temperature distribution overall. This proves that the flow of heat exchanging medium (coolant) is practically consistent over the entirety of the core main body without concentrating much in any particular area.

As in the previous embodiment, it has been confirmed that when the flow passage area of the constricting portion 19 mentioned above is made smaller relative to the other through holes 17, the temperature distribution changes subtly, depending upon its shape and the number of holes in it. Even when the constricting portion 19 is made by forming holes symmetrically at two positions above and below each other, or in the upper area and lower area of the distended portion for tank formation 7 of the formed plate **6*d* provided with the partitioning portion or the formed plate 6*e* adjacent to it, as shown in FIG. 4C or FIG. 4D, and the flow passage area remains constant, the temperature in the partitioning portion 18** near the outlet portion (the tube temperature and the passing air temperature) can be further kept down, providing an even smoother temperature distribution in the core main body.

In addition, the constricting portion 19 is not limited to those described above and may be constituted by forming two symmetrical holes at two locations, left and right, in the distended portion for tank formation in the formed plate **6*d* provided with the partitioning portion 18 or the formed plate 6*e* adjacent to it, as shown in FIG. 5A, or it may be constituted by forming two symmetrical holes relative to a hypothetical line which inclines at approximately 45°, as shown in FIG. 5**B.

The structure in which the constricting portion 19 is constituted with two holes also may include one in which two holes of different size are formed at the left and right in the distended portion for tank formation in the formed plate provided with the partitioning portion 18 or the formed plate adjacent to it, as shown in FIG. 5C or FIG. 5D, or two holes of different size may be formed above and below each other at two positions in the distended portion for tank formation, as shown in FIG. 5E or FIG. 5F.

Further variations in the shape of the constricting portion 19 for limiting the flow passage area are conceivable and, as shown in FIG. 6A, the hole may be a cross-shaped or, as shown in FIG. 6B, the constricting portion 19 may take a form in which small holes are provided at four locations, up, down, left and right. Furthermore, as shown in FIG. 6C, holes may be provided at three positions, i.e., in the upper, middle and lower parts of the distended portion for tank formation or, as shown in FIG. 6D, the constricting portion 19 may be constituted with three holes that are three sections created by dividing a circular hole into three approximately equal segments with their central angles approximately the same. Moreover, as shown in FIG. 6E, it may be constituted with four holes that are four sections of a circle divided into four equal segments with their central angles approximately the same.

In any of these forms, as long as the cross section area (when the constricting portion is constituted with a plurality of holes, the total area of the cross section areas of all the holes) S1 of the constricting portion 19 and the cross section area S2 of the through holes 17 retain the relationship expressed as $0.25 \leqq S1/S2 \leqq 0.80$, the advantages described earlier are achieved.

Note that while the state of the flow of heat exchanging medium is presumably also affected by the positions of the intake portion 4 and the outlet portion 5 and in particular by the position of the outlet portion 5, since the heat exchanging medium will tend to flow near the partitioning portion even without a constricting portion 19, as long as the outlet portion 5 is located close to the partitioning portion 18, this mode of the present invention is effective, specifically, when the outlet portion 5 is provided at a position within ¾ of the distance from the end to the partitioning portion 18 (in this embodiment, at any one of the tube elements TUBU Nos. 18~26).

As has been explained, according to the present invention, whether in a heat exchanger with the intake/outlet portions for heat exchanging medium provided at one end of the core main body in the direction of the lamination or in a heat exchanger with its intake/outlet portions provided in the direction running at a right angle to the direction of the lamination in the core main body, since a constricting portion is provided in the area where the flow of the heat exchanging medium shifts from an even-numbered pass to an odd-numbered pass where the flow tends to become uneven, more specifically, at a position which corresponds to the position of the partitioning portion which is partitioned to form a plurality of passes relative to the direction of the lamination in the tank group that is opposite the tank group in which the partitioned portion is provided to ensure that the heat exchanging medium flows in sufficient quantity into the tube elements near the partitioned portion, the uneven flow of the heat exchanging medium is prevented, achieving an improvement in heat exchanging efficiency.

What is claimed is:

1. A laminated heat exchanger comprising:

a tube element assembly including a plurality of tube elements laminated together along a direction of lamination, each of said tube elements including a pair of tank portions having through holes in the direction of lamination and a U-shaped passage communicating between said pair of tank portions, wherein each of said tube elements has one of said pair of tank portions located on a first side of said tube element assembly to form a first tank group, and the other of said pair of tank portions located on a second side of said tube element assembly to form a second tank group, a first tank subgroup constituted by a specific number of said tank portions of said first tank group which are disposed adjacent to each other so as to be fluidly connected, a second tank subgroup constituted by a specific number of said tank portions of said second tank group which are disposed adjacent to each other, said second tank subgroup fluidly communicating with said first tank subgroup through said U-shaped passages of said tube elements forming said tank portions of said first and second tank subgroups and the specific number of tank portions in said second tank subgroup equals the specific number of tank portions in said first tank subgroup, a first pass constituted bv one side of said U-shaped passages directly communicating with said tanks of said first tank subgroup, a second pass constituted by another side of said U-shaped passages directly communicating with said tanks of said second tank subgroup, a third tank subgroup constituted by adjacent tank portions of said second tank group which are not in said second tank subgroup, said third tank subgroup fluidly communicating with said second tank subgroup, and a fourth tank subgroup constituted by adjacent tank portions of said first tank group which are not in said first tank subgroup, said fourth tank subgroup fluidly communicating with said third tank subgroup through said U-shaped passages of said tube elements forming said tank portions of said third and fourth tank subgroups;

a third pass constituted by one side of U-shaped passages directly communicating with said tanks of said third tank subgroup, and a fourth pass constituted bv another side of said U-shaped passages directly communicating with said tanks of said fourth tank subgroup;

a partitioning portion dividing said first tank subgroup and said fourth tank subgroup such that said fourth tank subgroup is directly cut off from said first tank subgroup;

a plurality of fins laminated alternately with said tube elements;

a heat exchanging medium intake portion connected to one of said tank portions of said first tank subgroup, said one tank portion of said first tank subgroup being located approximately at a center of said first tank subgroup; and a heat exchanging medium outlet portion connected to one of said tank portions of said fourth tank subgroup, said one tank portion of said fourth tank subgroup being located approximately at a center of said fourth tank subgroup, wherein a constricting portion is formed by making said through hole in at least one tank portion smaller than said through holes in the other tank portions, said at least one tank portion being located at an upstream side with respect to an inflow direction of said heat exchanging medium in said third tank subgroup.

2. The laminated heat exchanger as claimed in claim 1, wherein a cross sectional opening area of said constricting portion is S1 and a cross sectional opening area of each of said other through holes is S2, and S1 and S2 are selected so that $0.25 \leqq S1/S2 \leqq 0.80$.

3. The laminated heat exchanger as claimed in claim 2, wherein a diameter of each of said other through holes is 15.7 mm and a diameter of said through hole at said constricting portion is within a range of 8 mm to 14 mm.

4. The laminated heat exchanger as claimed in claim 1, wherein a diameter of each of said other through holes is 15.7 mm and a diameter of said through hole forming said constricting portion is within a range of 8 mm to 14 mm.

* * * * *